US007400844B2

(12) United States Patent
Murakami et al.

(10) Patent No.: US 7,400,844 B2
(45) Date of Patent: Jul. 15, 2008

(54) IMAGE FORMING APPARATUS AND PROCESS CARTRIDGE WITH A CLEANER FOR REMOVING TONER FROM AN IMAGE BEARING MEMBER

(75) Inventors: Eisaku Murakami, Tokyo-to (JP); Hiroyuki Nagashima, Yokohama (JP); Masato Yanagida, Tokyo-to (JP); Naohiro Kumagai, Kawasaki (JP); Takeshi Shintani, Kawasaki (JP); Toshio Koike, Kawasaki (JP); Atsushi Sampe, Yokohama (JP); Masanori Kawasumi, Yokohama (JP); Masami Tomita, Numazu (JP); Takeshi Uchitani, Kamakura (JP)

(73) Assignee: Ricoh Company Limited, Tokyo (JP)

( * ) Notice: Subject to any disclaimer, the term of this patent is extended or adjusted under 35 U.S.C. 154(b) by 250 days.

(21) Appl. No.: 10/874,167

(22) Filed: Jun. 24, 2004

(65) Prior Publication Data

US 2005/0025520 A1 Feb. 3, 2005

(30) Foreign Application Priority Data

Jun. 24, 2003 (JP) ..... 2003-179467
Apr. 14, 2004 (JP) ..... 2004-118765

(51) Int. Cl.
*G03G 21/16* (2006.01)

(52) U.S. Cl. ..... 399/111; 399/346

(58) Field of Classification Search ..... 399/111, 399/346

See application file for complete search history.

(56) References Cited

U.S. PATENT DOCUMENTS

| | | | | |
|---|---|---|---|---|
| RE29,406 | E * | 9/1977 | Walker-Arnott | 399/367 |
| 4,571,066 | A * | 2/1986 | Morrison | 399/359 |
| 4,723,150 | A * | 2/1988 | Lutus et al. | 399/98 |
| 4,969,015 | A | 11/1990 | Sanpe | |
| 4,984,024 | A | 1/1991 | Ohkaji et al. | |
| 5,055,876 | A * | 10/1991 | Matsuoka et al. | 399/111 |
| 5,244,765 | A | 9/1993 | Katoh et al. | |
| 5,394,228 | A * | 2/1995 | Godlove | 399/345 |

(Continued)

FOREIGN PATENT DOCUMENTS

EP 1 286 225 A2 2/2003

(Continued)

OTHER PUBLICATIONS

U.S. Appl. No. 11/287,421, filed Nov. 28, 2005, Uchitani et al.

(Continued)

*Primary Examiner*—David M. Gray
*Assistant Examiner*—Ruth N Labombard
(74) *Attorney, Agent, or Firm*—Oblon, Spivak, McClelland, Maier & Neustadt, P.C.

(57) ABSTRACT

An image forming apparatus including a latent image bearing member, a charger, a latent image forming device, a developing device, a surface moving member, a transfer device, a cleaner having a cleaning blade and an irradiating device configured to discharge the latent image bearing member. This developing device is configured to develop images with a toner having a circularity not less than 0.94. The irradiating device is disposed on the upstream from the cleaner relative to the rotation direction of the latent image bearing member.

35 Claims, 7 Drawing Sheets

U.S. PATENT DOCUMENTS 5,396,319 A 3/1995 Tokuhashi et al.
5,452,065 A * 9/1995 Bell ..... 399/325
5,552,870 A 9/1996 Murakami et al.
5,597,311 A 1/1997 Yanagida et al.
5,600,428 A 2/1997 Yanagida
5,610,693 A 3/1997 Sugiyama et al.
5,614,998 A 3/1997 Sanpe
5,617,191 A 4/1997 Murakami et al.
5,638,158 A 6/1997 Sanpe et al.
5,734,952 A 3/1998 Murakami et al.
5,768,665 A 6/1998 Yamanaka et al.
5,826,144 A 10/1998 Takenaka et al.
5,840,456 A 11/1998 Tomita et al.
5,851,716 A 12/1998 Kuramoto et al.
5,879,752 A 3/1999 Murakami et al.
5,881,339 A 3/1999 Yanagida et al.
5,897,243 A 4/1999 Komatsubara et al.
5,915,156 A 6/1999 Kizaki et al.
5,970,282 A 10/1999 Yanagida et al.
5,975,446 A 11/1999 Yaguchi et al.
5,978,616 A * 11/1999 Shin ..... 399/50
5,995,789 A 11/1999 Murakami et al.
6,026,255 A 2/2000 Kizaki et al.
6,032,006 A 2/2000 Yanagida
6,074,794 A 6/2000 Fushimi et al.
6,103,441 A 8/2000 Tomita et al.
6,269,228 B1 * 7/2001 Kayahara et al. ..... 399/37
6,295,437 B1 * 9/2001 Hodoshima et al. ..... 399/346
6,295,438 B1 9/2001 Fujishiro et al.
6,356,726 B1 * 3/2002 Campbell et al. ..... 399/128
6,505,024 B2 1/2003 Kayahara et al.
6,522,842 B1 * 2/2003 Uehara et al. ..... 399/55
7,056,638 B1 8/2003 Tomita et al.
6,638,674 B2 * 10/2003 Komoto et al. ..... 430/106.1
6,654,574 B2 11/2003 Kayahara et al.
6,701,118 B2 3/2004 Kayahara et al.
6,775,511 B2 * 8/2004 Kosuge ..... 399/346
7,050,741 B2 * 5/2006 Koike et al. ..... 399/111
7,062,194 B2 * 6/2006 Yanagida et al. ..... 399/100
2001/0019674 A1 * 9/2001 Asano et al. ..... 399/223
2002/0106219 A1 8/2002 Sakai et al.
2002/0154243 A1 * 10/2002 Fife et al. ..... 348/372
2003/0161645 A1 * 8/2003 Azami et al. ..... 399/30
2003/0215269 A1 11/2003 Kayahara et al.
2004/0000753 A1 1/2004 Fukuchi
2004/0052560 A1 3/2004 Ishii et al.
2004/0096239 A1 5/2004 Hosokawa et al.
2004/0101328 A1 5/2004 Kimura et al.
2004/0106057 A1 * 6/2004 Tomita et al. ..... 430/108.6
2004/0114971 A1 6/2004 Sakai et al.
2004/0131381 A1 7/2004 Kawasumi et al.
2005/0036810 A1 2/2005 Murakami et al.
2005/0191574 A1 9/2005 Koike et al.
2005/0232665 A1 10/2005 Toshio et al.
2005/0232666 A1 10/2005 Ojimi et al.
2005/0271420 A1 12/2005 Arai et al.
2006/0018680 A1 1/2006 Hosokawa et al.

FOREIGN PATENT DOCUMENTS

JP 10-49017 2/1998
JP 2000-276024 10/2000
JP 2002-6710 1/2002
JP 2002-351279 12/2002

OTHER PUBLICATIONS

U.S. Appl. No. 11/226,197, filed Sep. 15, 2005, Kimura et al.
U.S. Appl. No. 11/207,819, filed Aug. 22, 2005, Shintani et al.
Patent Abstracts of Japan, JP 10-049017, Feb. 20, 1998.
U.S. Appl. No. 11/512,385, filed Aug. 30, 2006, Tomita.
U.S. Appl. No. 11/943,713, filed Nov. 21, 2007, Ishikawa et al.
U.S. Appl. No. 11/736,881, filed Apr. 18, 2007, Hosokawa, et al.

* cited by examiner

IMAGE FORMING APPARATUS AND PROCESS CARTRIDGE WITH A CLEANER FOR REMOVING TONER FROM AN IMAGE BEARING MEMBER

CROSS REFERENCE TO RELATED APPLICATIONS

This document claims priority to Japanese Patent Application Nos. 2003-179467 and 2004-118765, filed on Jun. 24, 2003, and Apr. 14, 2004, respectively, the disclosure of which are incorporated by reference herein in their entireties.

BACKGROUND OF THE INVENTION

1. Field of the Invention

The present invention relates to an image forming apparatus and a process cartridge performing electrostatic copying processes for use in copiers, facsimile machines, printers, etc. and more particularly, to an image forming apparatus and a process cartridge which can remove a toner having a high average circularity.

2. Discussion of the Background

Recently, color image forming apparatuses using electrophotography have been widely used. Almost all the images printed by these apparatuses are digitized before printing and thus a need for an image forming apparatus capable of printing further fine color images exists. It has been attempted to achieve images having a high resolution and a fine gradation using a toner having a high circularity and a small particle diameter.

It is known that a toner having a high circularity and a small particle diameter is precisely transferred and therefore suitable for obtaining a super fine image. However, toner particles having a high circularity tend to diffuse into a space between the cleaning blade used as a cleaner and a photoconductor. Therefore, it is difficult to remove the remaining toner particles on the photoconductor. Thus, the remaining toner particles tend to be transferred to a charger, resulting in contamination of the charging members such as the charging roller, thereby forming faulty images having, for example, uneven density and background development due to uneven charging.

Published unexamined Japanese patent application (hereinafter referred to as JOP) No. 2002-6710 discloses a cleaner containing a blade which accumulates and holds powder at its edge to block spherical toner particles having a form factor of from 100 to 125. Specific examples of such powder are monodisperse silica having a specific gravity of from 1.3 to 1.9 and a particle diameter of from 80 to 300 nm, and magnetic powder having an irregular form or a needle form. However, this device is required to have a powder supply means for supplying powder for blocking toner particles at a portion facing the blade edge or an upstream side therefrom, and a powder accumulating and holding means for blocking spherical toner particles by accumulating and holding powder at the blade edge. That is, the device is complex.

JOP No. 2000-276024 discloses a cleaner which removes remaining toner particles on a movable body. In this disclosure, a discharging means having a roller form is provided at an upstream side from the movable body relative to the moving direction thereof to apply an alternating current voltage while contacting with the movable body. Also a cleaner having a blade is provided at a downstream side from the movable body. The discharging means discharges the movable body and the remaining toner thereon so as to clear the movable body of the remaining toner. In JOP 2002-351279, to remove remaining toner particles on the photoconductor, a fur brush made of a conductive fabric is provided. In addition, a conductive collecting roller which applies a voltage while contacting the fur brush is provided. The remaining toner particles on the photoconductor drum are captured by the fur brush, which rotates while abrading the photoconductor, and are guided to the conductive roller as the fur brush rotates. Then the remaining toner is electrostatically attracted by the conductive collecting roller due to a voltage applied thereto. However, the apparatus has a disadvantage in that the cost increases because a powder supply means and other components have to be provided to apply the voltage.

Further, JOP No. 10-49017 discloses an image forming apparatus including an irradiator, which is provided at the upstream side of a cleaning blade relative to the rotation direction of an amorphous silicone photoconductor drum. This irradiator irradiates a photoconductor drum with light before cleaning to weaken the electrostatic force of toner particles remaining on the photoconductor drum. Then the toner particles remaining on the photoconductor drum are collected by a magnet roller and the collected toner particles are recycled, re-supplied and used for developing a latent image on the photoconductor. However, the technology disclosed is to prevent the photoconductor from deteriorating due to the abrasion caused by a single component magnetic toner held on a magnet roller. Therefore, it is difficult to apply this technology to a double component developer for use in forming color images.

For the above reasons, the need exists for a relatively simple image forming apparatus capable of producing further fine color images.

SUMMARY OF THE INVENTION

Accordingly, an object of the present invention is to provide an image forming apparatus and a process cartridge which can print quality images by using a toner having a substantially true sphere form while toner particles remaining on the latent image bearing member contained in the image forming apparatus or the process cartridge can be removed therefrom by a cleaner having a blade.

Briefly this object and other objects of the present invention, as hereinafter will become more readily apparent, can be attained by an image forming apparatus including a latent image bearing member configured to bear a latent image thereon. A charger contains a charging member which is in contact with or located closely to the latent image bearing member to charge the latent image bearing member. A latent image forming device is configured to form a latent image on the latent image bearing member. A developing device is configured to develop the latent image on the latent image member with toner. A surface moving member includes a surface that moves while contacting the latent image bearing member. A transfer device is configured to transfer the toner image formed on the latent image bearing member to the surface moving member or to a recording material sandwiched or disposed between the latent image bearing member and the surface moving member while forming a transferring electric field between the latent image bearing member and the surface moving member. A cleaner contains a cleaning blade configured to remove toner particles remaining on the latent image bearing member and an irradiating device configured to discharge the latent image bearing member on an upstream side from the cleaner relative to a rotation direction of the latent image bearing member. The toner used can have a circularity not less than 0.94.

It is preferred that the image forming apparatus further include a lubricant applicator which contains a brush roller configured to abrasively scrape a molded lubricant and to apply the lubricant to the latent image bearing member.

It is still further preferred that the latent image bearing member have a friction factor not greater than 0.4.

It is still further preferred that the lubricant applicator included in the image forming apparatus be provided in the cleaner.

It is still further preferred that the image forming apparatus contain a process cartridge detachably attached thereto. The process cartridge contains the latent image bearing member and at least one of the lubricant applicator, the charger, the developing device and the cleaner.

It is still further preferred that the latent image bearing member and at least one of the lubricant applicator, the charger, the developing device and the cleaner are integrally supported in the process cartridge.

It is still further preferred that the process cartridge further contain the irradiating device.

It is still further preferred that the latent image bearing member, at least one of the lubricant applicator, the charger, the developing device and the cleaner, and the irradiating device are integrally supported in the process cartridge which includes the irradiating device.

It is still further preferred that in the image forming apparatus the irradiating device include an electroluminescence or light emitting diode.

It is still further preferred that in the image forming apparatus, when the surface moving member is transparent, the irradiating device discharges the latent image bearing member by irradiating the latent image bearing member with light through the transparent surface moving member.

It is still further preferred that the toner for use in the image forming apparatus have a form factor (SF-1) of from 100 to 180 and another form factor (SF-2) of from 100 to 180.

It is still further preferred that the toner for use in the image forming apparatus have a volume average particle diameter (Dv) of from 3 to 8 μm and a ratio (Dv/Dn) of from 1.05 to 1.40, where Dn represents a number average particle diameter of the toner.

It is still further preferred that the toner for use in the image forming apparatus satisfy the following relationships: $0.5 \leqq r2/r1 \leqq 1.0$ and $0.7 \leqq r3/r2 \leqq 1.0$, where r1 is a major-axis particle diameter of the toner, r2 is a minor-axis particle diameter of the toner and r3 is a thickness of the toner, and wherein $r3 \leqq r2 \leqq r1$.

It is still further preferred that the toner for use in the image forming apparatus be prepared by a method including performing at least one of a crosslinking reaction and an elongation reaction of a toner constituent containing a polyester prepolymer having a functional group having a nitrogen atom, another polyester resin, a colorant, and a release agent in an aqueous medium in the presence of a particulate resin.

As another aspect of the present invention, a process cartridge is provided which is detachably attached to an image forming apparatus. The process cartridge includes a latent image bearing member configured to bear a latent image, at least one of a lubricant applicator configured to apply a lubricant to the latent image bearing member, a charger including a charging member which is in contact with or located closely to the latent image bearing member to charge the latent image bearing member, a developing device configured to develop the latent image on the latent image member with a toner and a cleaner including a cleaning blade configured to clear the latent image bearing member of the toner remaining thereon, and an irradiating device configured to discharge the latent image bearing member. The irradiating device is located on an upstream side from the cleaner relative to a rotation direction of the latent image bearing member.

It is preferred that the latent image bearing member, the at least one of a lubricant applicator, the charger, the developing device and the cleaner, and the irradiating device be integrally supported in the process cartridge.

It is still further preferred that the process cartridge further includes light shield members. The irradiating device can be provided outside the case of the process cartridge and sandwiched by or disposed between the light shield members.

It is still further preferred that the process cartridge use a toner having a circularity not less than 0.94.

These and other objects, features and/or advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention is now described below in detail with reference to several embodiments and accompanying drawings.

Figure 1:
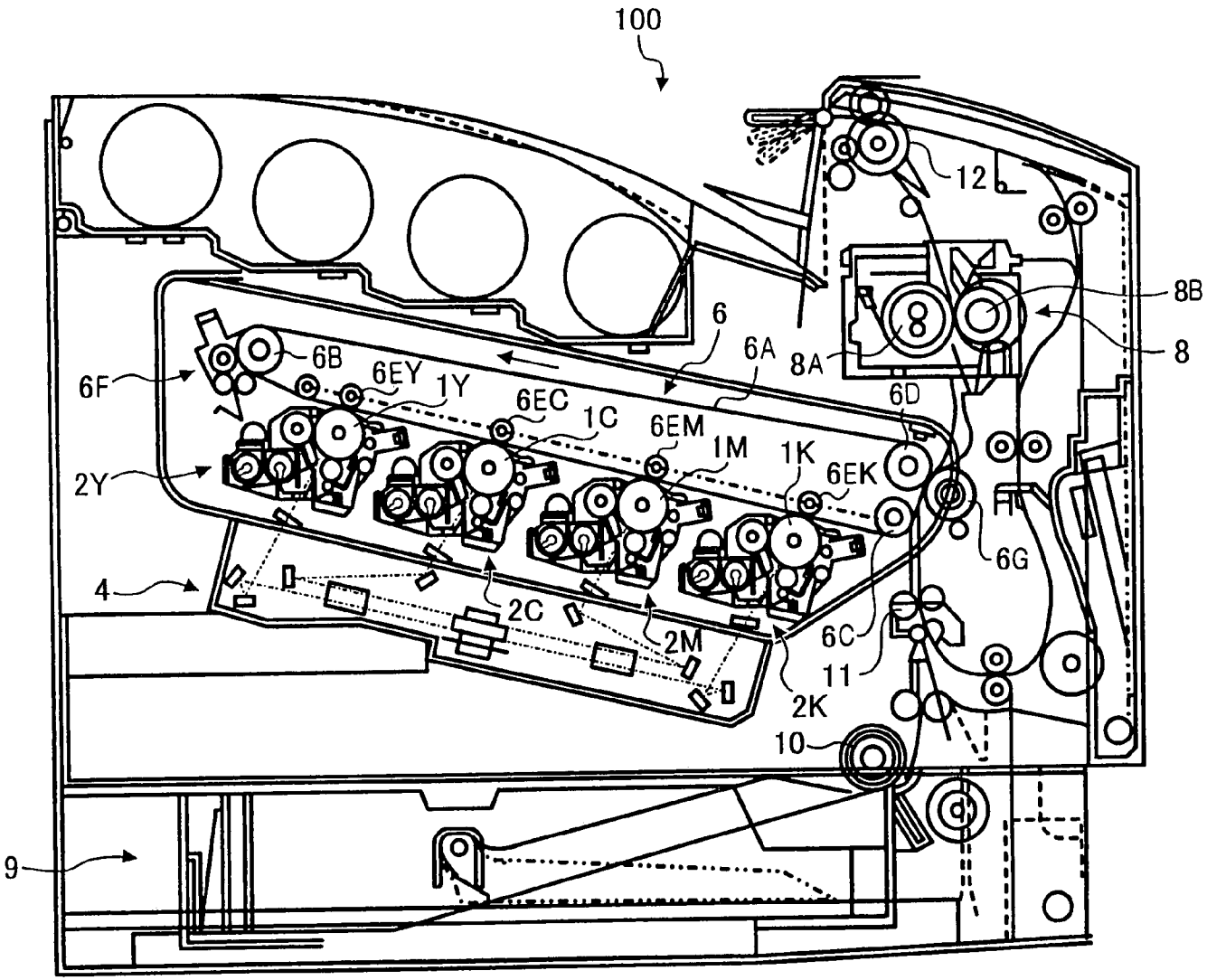
FIG. 1 is an elevation view showing the image forming apparatus according to an embodiment of the present invention.

FIG. 1 is an elevation view showing an image forming apparatus 100 according to an embodiment of the present invention. Preferably, the image forming apparatus 100 uses electrophotography. The image forming apparatus 100 is referred to as "tandem image forming apparatus" and forms color images by using four color toners. The four color toners are yellow, cyan, magenta and black (hereinafter referred to as Y, C, M and K, respectively). This image forming apparatus 100 has four photoconductors 1Y, 1C, 1M and 1K as the latent image bearing members. In this embodiment, the photoconductor 1 including a roller is used but a photoconductor including a belt can be used. Each photoconductor 1Y, 1C, 1M and 1K rotates in the direction indicated by the arrow illustrated in FIG. 1 while each photoconductor contacts an intermediary transfer belt 6A serving as a surface movable member.

Figure 2:
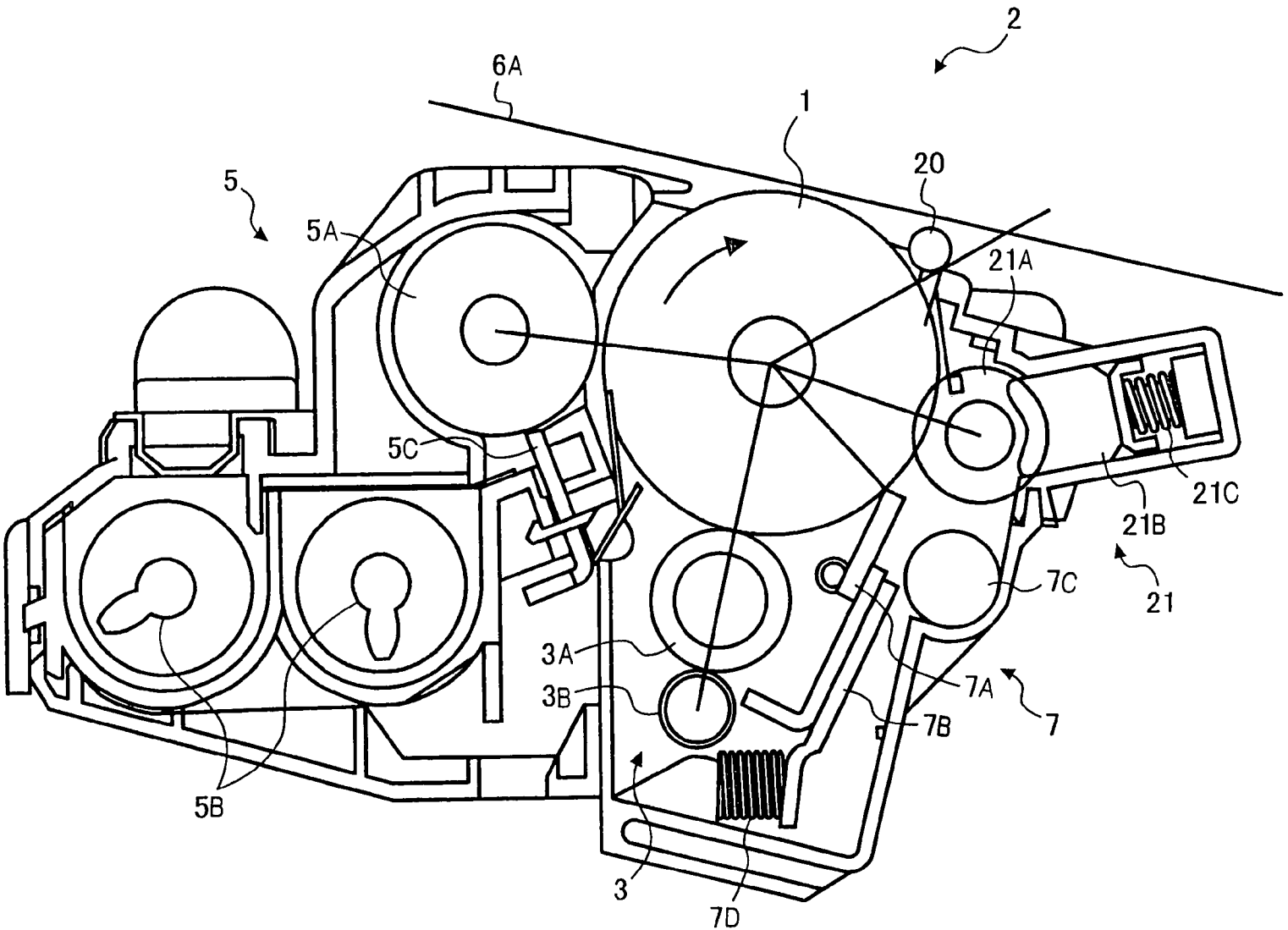
FIG. 2 is a detail view of the image forming unit of the image forming apparatus shown in FIG. 1.

FIG. 2 is a detail view of the image forming unit 2 of the image forming apparatus 100, the image forming unit 2 including the photoconductor 1. The characters indicating color (Y, C, M and K) are omitted because arrangements of components around photoconductor 1Y, 1C, 1M and 1K contained in image forming unit 2Y, 2C, 2M and 2K, respectively, is similar. Thus, only one image forming unit 2 is representatively illustrated in this figure. A developing device 5 which includes a stirring convey screw 5B and a doctor blade 5C and which is configured to convert a latent image into a toner image, a pre-cleaning discharger (hereinafter referred to as PCL, which represents PreCleaningLamp) 20 such as an irradiating device configured to discharge the charged electric potential of the photoconductor 1, a lubricant applicator 21 configured to apply a lubricant to the photoconductor 1, a cleaner 7 for removing toner particles remaining on the photoconductor 1, and a charger 3 configured to charge the photoconductor 1, are placed around the photoconductor 1 according to the moving direction of the surface of the photoconductor 1. This image forming unit 2 preferably can serve as process cartridge.

The image forming apparatus 100 of the present invention is further described with reference to FIGS. 1 and 2.

The charger 3 charges the surface of the photoconductor 1 with a negative polarity. The charger 3 in this embodiment contains a charging roller 3A as a charging member, which performs charging while the charging roller 3A is in contact with or placed closely to the photoconductor 1. That is, the charger roller 3A included in the charger 3 is in contact with or placed closely to the photoconductor 1 and the charger 3 applies a negative bias to the charging roller 3A to charge the surface of the photoconductor 1. The direct current charging bias is applied to the charging roller 3A such that the surface potential of the photoconductor 1 ranges from −400 to −500 V. As charging bias, it is possible to apply a direct current voltage overlapped with an alternating current voltage. In addition, the charger 3 can contain a cleaning roller 3B configured to clean the surface of the charging roller 3A. Thereby, poor charging, such as uneven charging due to the charging roller, 3A can be avoided even when a small amount of toner is attached to the charging roller 3A. Furthermore, it is allowed to roll a thin film around both ends of the peripheral surface of the charging roller 3A in the axial direction and contact the thin-film-rolled charging roller with the surface of the photoconductor 1. In this case, the surface of the charging roller 3A can be set very close to the surface of the photoconductor 1 such that the distance therebetween is equal to the thickness of the thin film. Thereby, the probability of the charging roller 3A contacting with the toner remaining on the photoconductor 1 is reduced.

After the surface of the photoconductor 1 is charged, latent images corresponding to different colors are formed on the surface of the photoconductor 1 when a latent image forming device such as an irradiating device 4 irradiates the surface of the photoconductor 1. The irradiating device 4 in this embodiment is an irradiator using a light beam, but other irradiators can be used, such as an irradiator composed of LED arrays and an image focusing device.

The developing device 5 contains a developing roller 5A serving as a developer bearing member which is partially exposed from the opening of the casing of the developing device 5. The toner preferably used in this embodiment is a double component developer containing a toner and a carrier. However, a single component developer including no carrier can be also used. The developing device 5 contains toners therein, which are replenished from respective color toner bottles. The developing roller 5A contains a magnet roller serving generating a magnetic field and a developing sleeve which coaxially rotates around the magnet roller. The magnetic force generated by the magnet roller forms filaments of carriers contained in the developer on the developing roller 5A. The carrier filaments are transferred to an area (hereinafter referred to as developing area) where the developing roller 5A faces the photoconductor 1. The surface of the developing roller 5A and the surface of the photoconductor 1 move in the same direction at the developing area while the linear velocity of the former is relatively faster that the latter. At this point, a bias of −300 V is applied to the surface of the developing roller 5A by a power supply (not shown) to thereby form the developing electric field at the developing area. Thus, when the carrier filaments on the developing roller 5A abrade the surface of the photoconductor 1, the toner particles attached to the surface of the carrier are attracted to the surface of the photoconductor 1 to perform development.

The intermediary transfer belt 6A (i.e., an endless belt), which is included in a transfer device 6, is stretched onto three supporting rollers 6B, 6C and 6D and moves in the direction indicated by the arrow illustrated in the figure. On the intermediary belt 6A, the toner images on each photoconductor 1Y, 1C, 1M and 1K are transferred on each other by an electrostatic transfer method. A transfer charger can be used in the electrostatic transfer method but a first transfer roller 6E which can restrain the amount of dust generated at the time of transfer, is used in this embodiment. Specifically, on the back of each portion of the intermediary transfer belt 6A which contacts each photoconductor 1Y, 1C, 1M and 1K, first transfer rollers 6EY, 6EC, 6EM and 6EK are placed as transfer device 6. A first transfer area is formed between a portion of the intermediary transfer belt 6A pressed by the first transfer roller 6E and the photoconductor 1. When each toner image on each photoconductor 1Y, 1C, 1M and 1K is transferred to the intermediary transfer belt 6A, a positive bias is applied to the first transfer roller 6E. Thereby, a transfer electric field is formed in the area (hereinafter referred to as transfer area) where each first transfer is performed. Therefore, the toner images on each photoconductor 1Y, 1C, 1M and 1K are electrostatically attached and thus transferred to the intermediary transfer belt 6A.

A belt cleaning device 6F configured to remove toners remaining on the surface of the intermediary transfer belt 6A is provided adjacent the intermediary belt 6A. The belt cleaning device 6F collects extraneous toners disposed on the surface of the intermediary transfer belt 6A with a fur brush and a cleaning blade. The extraneous toner is transferred from the belt cleaning device 6F to a waste toner bottle (not shown) by a transfer means or unit (not shown). The intermediary transfer belt 6A can be an endless single layer belt having a volume resistance of from 109 to 1011 Ωm and is preferably made of poly vinylidene fluoride (PVDF). Also multiple resin layers including an elastic layer can be used.

In addition, a second transfer roller 6G is provided so as to be brought into contact with the portion of the intermediary transfer belt 6A which is stretched on the supporting roller 6D. A second transfer area is formed between this intermediary belt 6A and the second transfer roller 6G. A transfer paper serving as a recording material is fed to this second transfer area according to the predetermined timing. This transfer paper is set in a paper feeder cassette 9 located below the irradiating device 4 as illustrated in FIG. 1 and transferred to the second transfer area by a pickup roller 10, a pair of register rollers 11, etc.

The overlaid toner image on the intermediary transfer belt 6A is transferred to the transfer paper altogether at the second transfer area. At the time of this second transfer, a positive bias is applied to the second transfer roller 6G to form a transfer electric field and thereby the toner image on the intermediary transfer belt 6A is transferred to the transfer paper.

The lubricant applicator 21 configured to apply a lubricant mainly contains a molded lubricant 21B set in a fixed case, a brush roller 21A located so as to contact the molded lubricant 21B for scraping and applying the lubricant, and a pressure spring 21C which compresses the molded lubricant 21B to the brush roller 21A. The molded lubricant 21B preferably has a rectangular solid form, and more preferably has a stick form. In addition the brush roller 21B extends in the axial direction of the photoconductor 1. Although the molded lubricant 21B is an expendable item and thus the thickness decreases with time, the pressure spring 21C applies a force to the molded lubricant 21B against the brush roller 21A and therefore the molded lubricant 21B is constantly pressed to contact the brush roller 21A. Thus, almost all of the molded lubricant 21B can be used.

The lubricant applicator 21 can be provided in the cleaner 7 together with the cleaning blade 7A. In this case, toners remaining on the photoconductor 1 attach to the brush when the brush abrades the photoconductor 1. Then the toners attached to the brush are shaken off by a flicker (not shown) and transferred to a collection and transfer means (not shown) or drop off for collection when the toners attached to the brush contact the molded lubricant 21B.

Specific preferred examples of such lubricants include aliphatic fatty acid metal salts, silicone oils and fluorine-containing resins. These can be used alone or in combination. Specific preferred examples of the fatty acids forming the fatty acid metal salts include straight chain hydrocarbons, such as myristic acid, palmitic acid, stearic acid and oleic acid. Specific preferred examples of the metals include lithium, magnesium, calcium, strontium, zinc, cadmium, aluminum, cerium, titan, and iron. Specific preferred examples of the fatty acid metal salts include zinc stearate, magnesium stearate, aluminum stearate and iron stearate.

The cleaner 7 contains the cleaning blade 7A, a supporting member 7B, a toner collecting coil 7C and a blade pressure spring 7D. The cleaning blade 7A removes toners remaining on the photoconductor after transfer. The cleaning blade 7A is provided to the cleaner 7 by attaching the cleaning blade 7A to the supporting member 7B. The supporting member 7B has no specific preferred material and can be made of metals, plastics, ceramics, etc.

The cleaning blade 7A can use an elastic substance having a low friction factor, for example, urethane resins, silicone resins and fluorine containing resins. Examples of preferred resins include urethane elastomers, silicone elastomers and fluorine elastomers. For a cleaning blade 7A, hot curing urethane resins are preferred. Urethane elastomers are preferred in terms of anti-abrasion, anti-ozone and anti-contamination. The elastomers mentioned above include rubber. The cleaning blade 7A preferably has a degree of hardness of from 65 to 85 by JIS-A. The cleaning blade 7A preferably has a thickness of from 0.8 to 3.0 mm and a protrusion of from 3 to 15 mm. Further conditions such as contact pressure, contact angle, the amount of inroad can be optionally determined.

The image forming apparatus 100 of the present invention can use a toner having an average circularity not less than 0.94.

To obtain this average circularity, toners made of dry pulverization are subject to thermal or mechanical sphere treatment.

The thermal sphere treatment is performed by, for example, spraying toner particles to an atomizer, etc. with a heated airflow. The mechanical sphere treatment is performed by stirring toners with a mixture solvent including ingredients having a small specific gravity (e.g., glass) in a mixing device (e.g., a ball mill). However, in the thermal sphere treatment, the toner particles tend to aggregate and thus the toner particles obtained have a large particle diameter. In contrast, in the mechanical sphere treatment, fine powder toners tend to be generated. Therefore, an additional classification process can be used.

In the case of toners prepared in an aqueous solvent, the form of the toner can be controlled by vigorously stirring in the process of removing the solvent.

The circularity is defined by the following relationship: Circularity SR=(the circumferential length of the circle having the area equal to a projected toner area/the circumferential length of the projected toner area)×100%. The SR value is close to 100% as a toner particle gets closer to a true sphere. When toners having a high circularity are on carriers or a developing roller 5A, such toners tend to be affected by lines of electric force and thus the toner is transferred precisely along the lines of electric force of a latent electrostatic image. When fine latent dots are reproduced, fine line reproducibility becomes excellent since the toners can be densely and uniformly arranged. Further, toners having a high circularity value have a smooth surface and a good fluidity and thus tend to be affected by lines of electrical force. Therefore, the toners are easily transferred exactly along the lines of electric force. As a result, the transfer rate tends to be high and a quality image can be obtained. Furthermore, when the intermediary transfer belt 6A is pressed to the photoconductor 1, toners having a high circularity value evenly contact the intermediary transfer belt 6A and the contact area of the toners is uniform, resulting in improvement of the transfer rate. In contrast, when toners have an average circularity less than 0.94, it is impossible to perform exact development and a high rate transfer. This is because the surface of toners having an irregular form are not charged uniformly and are hard to move exactly along an electric field since the center of the gravity is deviated from that of the charge.

However, toners having a high circularity value easily diffuse into a gap between the cleaning blade 7A and the photoconductor 1, resulting in poor cleaning performance. Therefore, to reduce the attachment force between toners and the photoconductor 1, a pre-cleaning discharger 20 (PCL) serving as an irradiating device is provided for the image forming apparatus 100 of the present invention in order to discharge the photoconductor 1. As illustrated in FIG. 2, the PCL 20 is provided on the downstream side from the transfer area and on the upstream side from the cleaner 7. The PCL 20 can reduce the amount of charge of the photoconductor 1 before cleaning and therefore removing the toners remaining on the photoconductor 1 can be more easily achieved. Specific examples of the PCL 20 include laser diodes (LDs), light emitting diodes (LEDs), electroluminescences (ELs), and fluorescent lamps, which can reduce the amount of charge on the photoconductor 1 by irradiating the photoconductor 1 with light. The PCL 20 is preferably an EL or LD and more preferably an EL because it has a simple structure. ELs are light weight and thin relative to fluorescent lamps. In addition, ELs can irradiate a wide area compared with LEDs which contain small elements arranged in array. When the PCL 20 is set within the transfer device 6 and further the intermediary transfer belt 6A is made of a resin having a high transparency, the PCL 20 can irradiate the photoconductor 1 through the intermediary transfer belt 6A.

Figure 3:
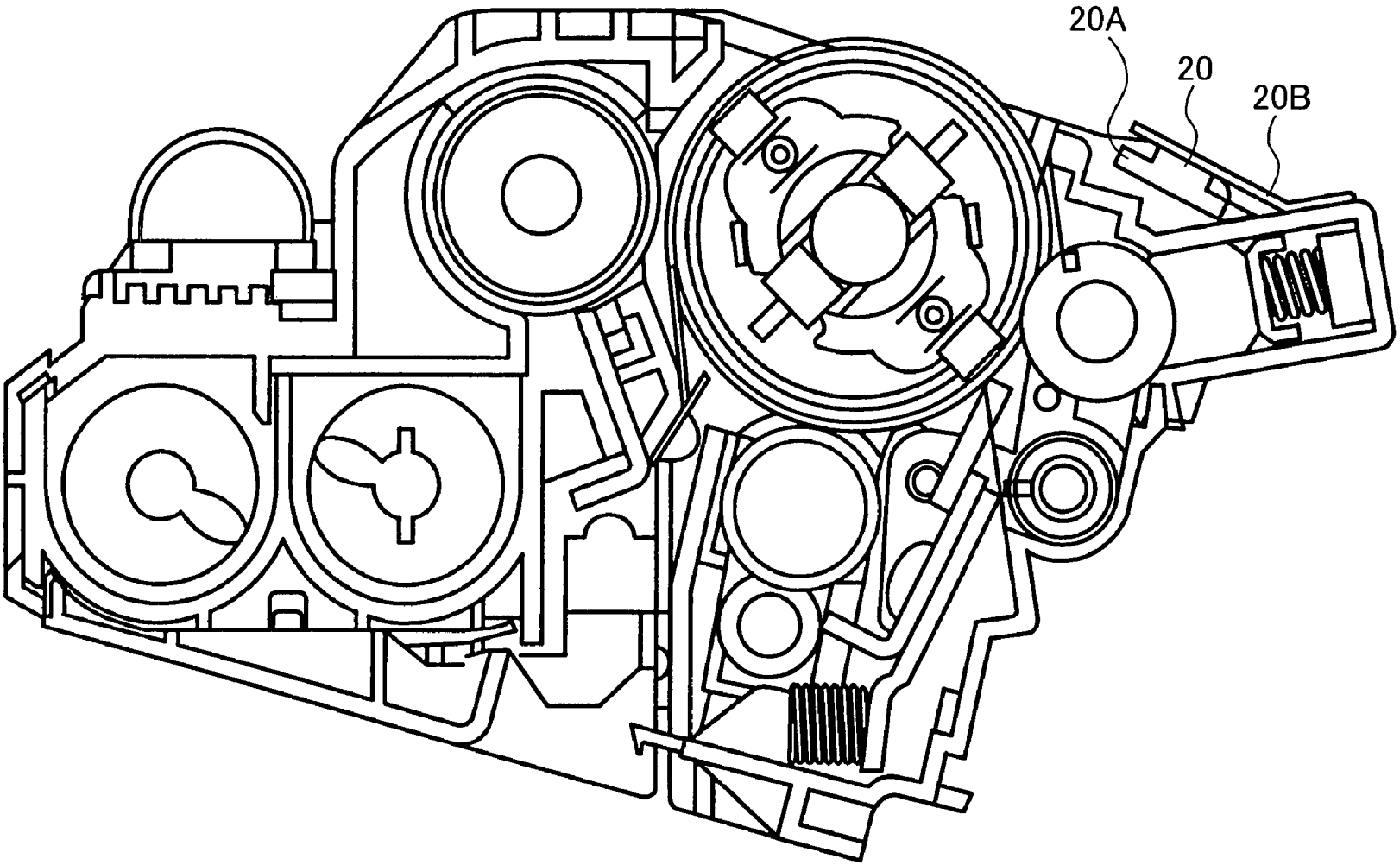
FIG. 3 is an elevation view of the process cartridge according to an embodiment of the present invention in which a light emitting device is attached to the case to discharge the photoconductor therein.

Next another embodiment will be described with reference to FIG. 3.

Outside the case where the photoconductor 1 and the cleaner 7 are provided, a base plate 20A to which the PCL 20 can be provided and a light shield member 20B to sandwich the PCL 20 are provided. A black mylar is adopted as light shield member 20B. The light shield member 20B can prevent the light irradiated from the PCL 20 from reaching the transfer belt and thus the images obtained are not defective. In addition, by providing the light shield member 20B on the base plate 20A for the PCL 20, the base plate 20A is not directly exposed when the process cartridge 2 is pulled out. Further, by providing the base plate 20A on the case and the light shield member 20B on the base plate 20A, the PCL 20 can be easily maintained and also the process cartridge 2 does not have to be increased in size.

Image forming operations of the image forming apparatus 100 of the present invention are now described with reference to the image forming unit 2. When the image forming operation starts, the charger 3 uniformly charges the surface of the photoconductor 1 with a negative bias. The irradiating device 4 scans the surface of the photoconductor 1 with a laser beam according to image data to form a latent image thereon. The developing device 5 converts this latent image into a toner image. The toner used is preferably a two-component developer including a carrier, which is suitable for a color toner.

When the photoconductor 1 on which the toner image is formed rotates to the transfer area, the toner image contacts a portion of the intermediary belt 6A which moves into the transfer area at the same timing. At the transfer area, the toner developed on the photoconductor 1 is transferred to the intermediary transfer belt 6A by function of the electric field and upon an application of nipping pressure. The toner image is formed on the intermediary transfer belt 6A through this transfer. When the "tandem image forming apparatus" is used, there are a plurality of the photoconductor is therein, the number of which is equivalent to that of the number of color toners used. Therefore, this transfer operation is repeated multiple times to form a color toner image on the intermediary transfer belt 6A.

The toner image on the intermediary transfer belt 6A is transferred to a recording member at the second transfer area by function of the electric field and upon application of nipping pressure. The recording member is fed from the paper feeder cassette 9 and guided to the pair of register rollers 11 by a transfer roller using a transfer guide (not shown) to the second transfer area according to the predetermined timing. The full color toner image is formed on the recording member through this transfer. The recording member on which the full color toner image is formed is fixed at a fixing device 8 which contains a heat roller 8A and a pressure roller 8B and then discharged to an output tray of the image forming apparatus 100 via a paper discharging roller 12.

The surface potential of the photoconductor 1 before the transfer is performed is −500 V at the ground (white background portion) and −50 V at the image portion which has been irradiated by a laser beam. A developing bias having a direct current voltage of −500 V and an alternating current voltage of from 0.5 to 2 kV is applied to toners having a negative polarity and thus the toners are attached to the image portion. At the transfer area, the toner image is transferred to the intermediary transfer belt 6A by a transfer bias having a direct current voltage of 400 to 450 V and an alternating current voltage of from 0.5 to 2 kV. After the transfer, the surface potential of the photoconductor 1 is about −200V at the ground portion (white background portion) and about −10 V at the image portion. The toners remaining on the photoconductor 1 after the transfer is strongly attracted to the edge portion of the image on the surface of the photoconductor 1 by the force of the electric field formed by the −200 V and −10 V. These toner particles diffuse through the cleaning blade 7A and are charged in the next image forming process, resulting in a defective image having, for example, background development and white spots. To prevent this poor cleaning performance, the PCL 20 irradiates the photoconductor 1 with light to change the potential of the ground portion having no toner thereon from −200 to 0 V to form an electric field between this 0 V and the −10 V which is applied to the image portion, thereby reducing the attraction force between the toner and the photoconductor 1.

After this, the brush roller 21A included in the lubricant applicator 21 abrasively scrapes the lubricant, i.e., zinc stearate, from the molded lubricant 21B and the scraped toner is attached to the brush roller 21A. Next the brush roller 21A abrades the surface of the photoconductor 1 to apply the lubricant thereto. Then the lubricant is pressed to the photoconductor 1 to form a thin film thereon by the cleaning blade 7A which contacts the photoconductor 1. The toner particles on the photoconductor 1 where this thin film is formed are easy to remove. Further, considering that the electric field formed between the toners and the surface of the photoconductor 1 has been weakened and therefore the attraction force therebetween has also been weakened, it is possible to clear the photoconductor 1 of even the toner particles having a high average circularity not less than 0.94.

Furthermore, the lubricant thin film formed on the photoconductor 1 reduces the friction factor of the photoconductor 1. The friction factor μ of the photoconductor 1 is preferably not greater than 0.4 at this time. This friction factor μ can be controlled by the setting conditions of the lubricant applicator 21 such as the pressure from the pressure spring 21C against the molded lubricant 21B, the brush density of the brush roller 21A, the diameter of the brush, the number of rotation of the roller and the rotation direction.

By limiting the friction factor μ of the photoconductor 1 to be not greater than 0.4, the friction between the photoconductor 1 and the cleaning blade 7A can be restrained. Therefore, the cleaning blade 7A can avoid deformation and curling up and prevents the toner particles remaining on the photoconductor 1 from diffusing therethrough, resulting in prevention of poor cleaning performances. The friction factor μ of the photoconductor is more preferably not greater than 0.3.

Figure 4:
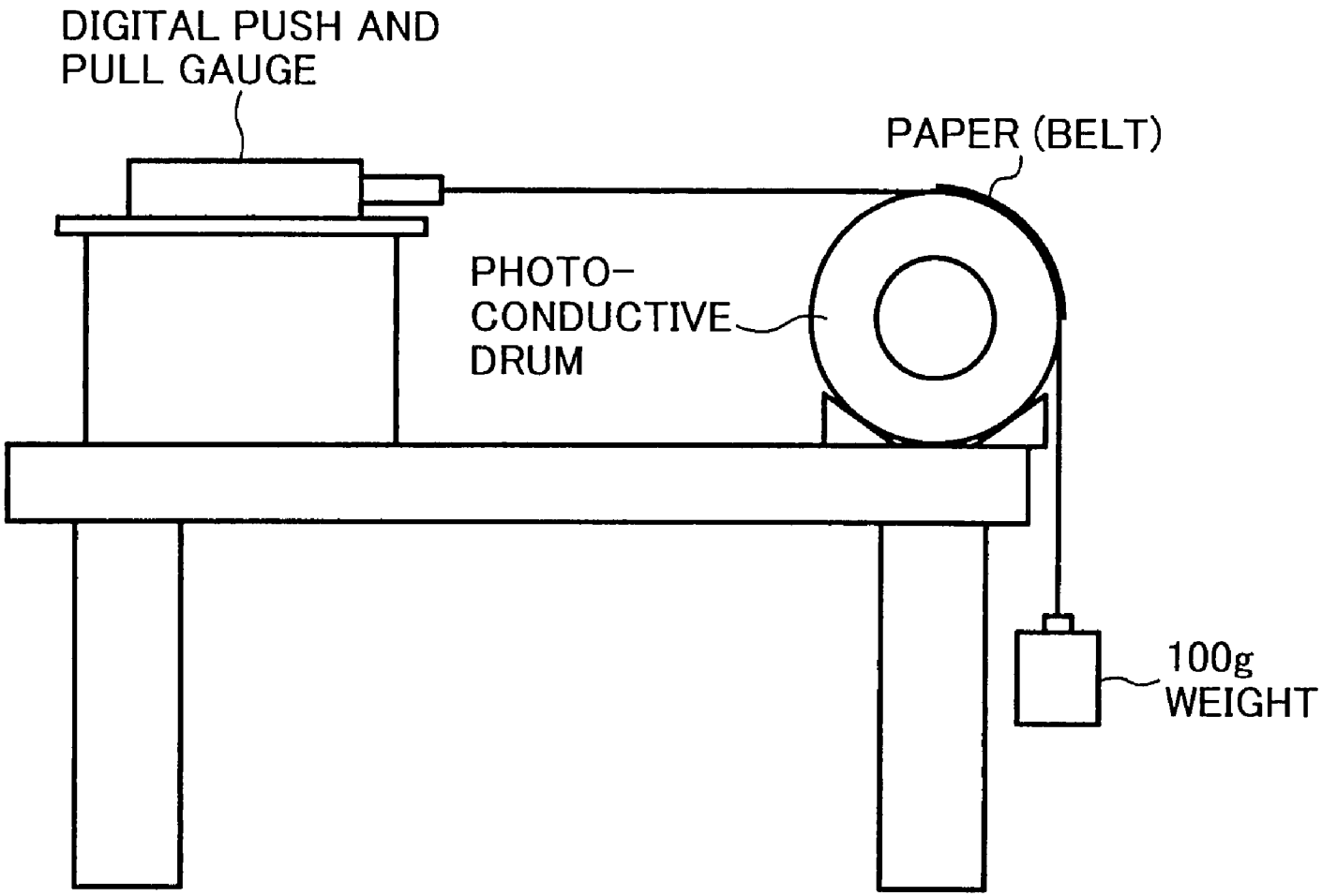
FIG. 4 is an elevation view showing the method of measuring the friction factor of the photoconductor.

The friction factor μ of the photoconductor 1 is measured by the Oiler belt method. FIG. 4 is an elevation view showing the method of measuring the friction factor μ of the photoconductor 1. The measuring method is as follows: Stretch a quality paper of a medium thickness serving as a belt in the longitudinal direction over one quarter of the circumference of the photoconductor drum 1; Attach a force gauge to one side of the belt and a weight of, for example, 100 gr (i.e., a force of 0.98 N) to the other side thereof to pull the force gauge; Increase the weight until the belt moves; Read the value of the gauge when the belt moves; Assign the value into the following relationships: $\mu s=2/\pi\times\ln(F/0.98)$, where μs is static friction factor, F is the measured value; and calculate the friction factor of the photoconductor 1. In this embodiment, the friction factor μ of the photoconductor 1 of the image forming apparatus 100 is the value obtained after it becomes constant. This is because the friction factor μ of the photoconductor 1 of the image forming apparatus 100 initially varies due to the other components provided in the image forming apparatus 100. The friction factor μ becomes constant after about 1,000 sheets of A4 paper are used for image formation.

Toners having a relatively small volume average particle diameter (Dv) are excellent in improving fine line reproducibility. Therefore, it is preferred to use a toner having a volume average particle diameter not greater than 8 μm. However, when the volume average particle diameter of the toner is too small, developability and cleanability deteriorate. In addition, toner particles having a too small particle diameter tend to be hard to be developed and therefore the number of such toner particles increases on the surface of carriers and the developing roller 5A. Consequently, such toner particles cannot sufficiently contact other carriers or the developing roller 5A and thus the number of the reversely charged toner particles increases, resulting in defective images having, for example, background development. Thus, the volume average particle diameter is preferably not less than 3 μm.

The particle diameter distribution represented by a ratio (Dv/Dn) of the volume average particle diameter (Dv) to the number average particle diameter (Dn) is preferably from 1.05 to 1.40.

By using a toner having a sharp particle diameter distribution, the toner charge distribution can be uniformed. When the ratio (Dv/Dn) is too large, the toner charge distribution is wide and the number of reversely charged toner particles T1 increases and therefore, quality images may be difficult to obtain. When the ratio (Dv/Dn) is too small, manufacturing such toner particles may be difficult and therefore not practical. The particle diameter of a toner is measured using COULTER COUNTER MULTI-SIZER (manufactured by Beckman Coulter, Inc.) with an aperture of 50 μm which is selected according to the particle diameter of the toners to be measured. The average particle diameter is calculated based on measurement of 50,000 toner particles.

Figure 5A:
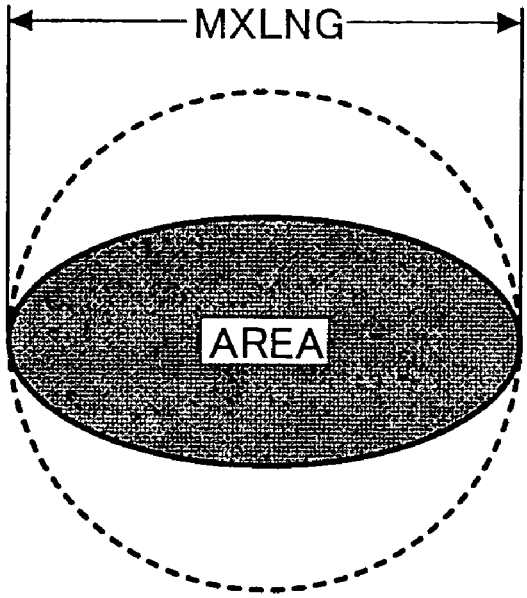
FIG. 5A and FIG. 5B are projected images of toner particles showing the factors of SF-1 and SF-2, respectively.
Figure 5B:
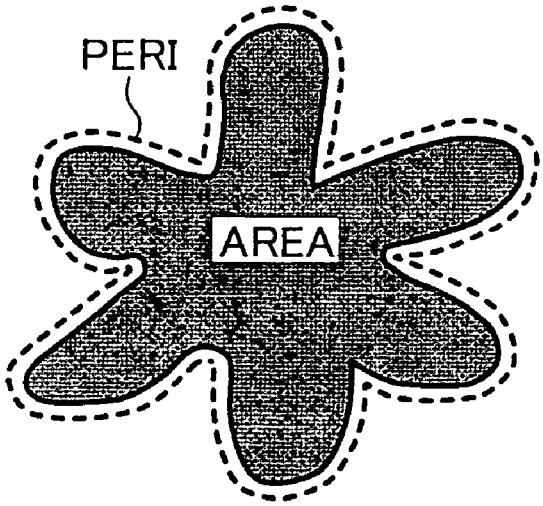

The toner for use in the image forming apparatus 100 preferably has a form having a form factor SF-1 of from 100 to 180, and a form factor SF-2 of from 100 to 180 with regard to circularity. FIG. 5A and FIG. 5B show the form factor SF-1 and SF-2 of the toner particles. As shown in FIG. 5A, the form factor SF-1 is the degree of roundness of a toner particle and is defined by the following equation (1):

$$SF\text{-}1=((MXLNG)2/(\text{AREA}))\times(100\pi/4) \quad (1)$$

where MXLNG is a diameter of the circle circumscribing the image of a toner particle obtained, for example, by observing the toner particle with a microscope, and AREA is the area of the image.

When the SF-1 is 100, the toner particle is a true sphere. It can be said that as SF-1 increases, the toner form differs away from a true sphere form.

As illustrated in FIG. 5B, the form factor SF-2 is the degree of concavity and convexity of a toner particle and is defined by the following equation (2):

$$SF\text{-}2=((PERI)2/(AREA))\times(100/4\pi) \quad (2)$$

where PERI is the peripheral length, or perimeter, of the image of a toner particle observed, for example, by a microscope; and AREA is the area of the image.

When the SF-2 is 100, the surface of the toner particle does not have any concavity or convexity. It can be said that as SF-2 increases, the toner surface becomes rough.

The form factors SF-1 and SF-2 are determined by the following method:

(1) a photograph of particles of a toner is taken using a scanning electron microscope (S-800, manufactured by Hitachi Ltd.); and (2) particle images of 100 toner particles are analyzed using an image analyzer (LUSEX 3 manufactured by Nireco Corp.).

When the toner has a form close to a true sphere, the contact between toner particles becomes point to point contact. Thus, the adhesion force between toner particles weakens and therefore, the toner has a good fluidity. In addition, the adhesion force between the toner and the photoconductor 1 is also weak and the transfer rate of the toner is high. Therefore, the toners remaining on the photoconductor 1 are easy to remove.

It is preferred that the form factors SF-1 and SF-2 be not less than 100. When the form factors SF-1 and SF-2 are large, the toner form is irregular and the toner charge distribution is wide. Therefore, the image developed from a latent image is not true thereto. Further, transferring an image is not performed truly to a transfer electric field, resulting in deterioration of the quality of images. Furthermore, the transfer rate declines and the amount of the amount of remaining toner increases. To avoid this, a large cleaner 7 can be used, which is disadvantageous in terms of designing the image forming apparatus 100. Therefore, it is preferred that SF-1 and SF-2 both be not greater than 180.

Figure 6A:
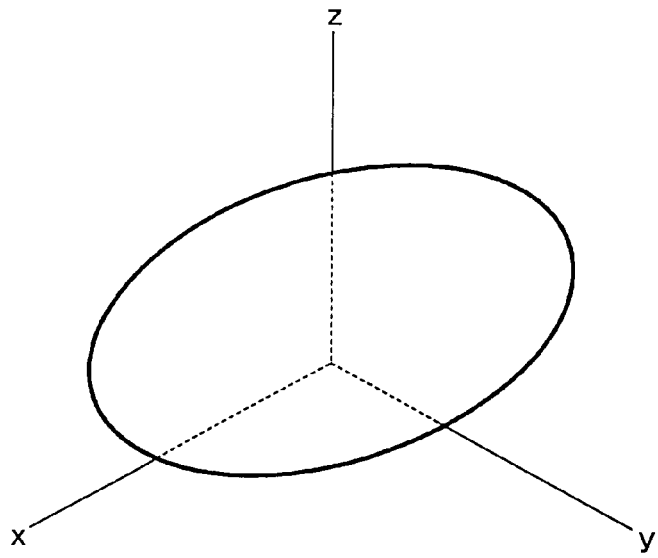
FIG. 6A shows the appearance of the toner particle.
Figure 6B:
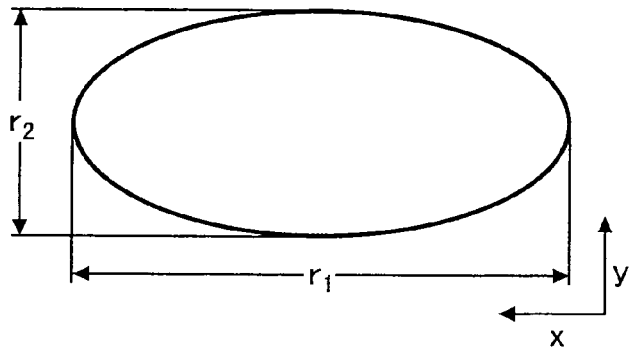
FIGS. 6B and 6C are cross section views showing the factors r1, r2, and r3 of the toner particle.
Figure 6C:
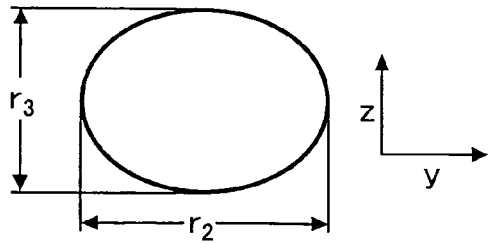

In addition, the toner for use in the image forming apparatus 100 can have a substantially sphere form. FIG. 6 show the appearance and form of the toner. FIG. 6A shows the appearance of the toner and FIG. 6B shows a cross sectional view of the toner particle. In FIG. 6A, a major axis r1, which is the longest axis of the toner particle, is along the x-axis, a minor axis r2, which is the second longest axis thereof, is along the y-axis, and a thickness r3, which is the shortest axis thereof, is along the z-axis. The relationships between r1, r2 and r3 are: $r3 \leqq r2 \leqq r1$. This toner particle is substantially a true sphere satisfying the following relationships: $0.5 \leqq r2/r1 \leqq 1.0$; and $0.7 \leqq r3/r2 \leqq 1.0$. When the ratio (r3/r2) is 1.0, the toner particle is a substantially true sphere and thus the toner charge distribution is narrow. However, when the ratio (r2/r1) is too small, the particle form of the toner is apart from the true sphere and thus the toner charge distribution is wide. Also, when the ratio (r3/r2) is too small, the particle form of the toner is also apart from the true sphere form and thus the toner charge distribution is wide.

The particle diameters, i.e., r1, r2 and r3, of a toner particle are determined by observing 100 toner particles with a scanning electron microscope while the viewing angle is changed.

The form of the toner can be dependent on manufacturing methods. For example, the toner made by using dry pulverization methods has a rough surface and an irregular form. However, the toner made by this dry pulverization method can be made to be close to the true sphere when the toner is subject to mechanical or heat treatment. The toner made by forming a droplet using suspension polymerization methods or emulsion polymerization methods generally has a smooth surface and is close to the true sphere form. In addition, the toner can have an oval form when the toner constituent is stirred and sheared in the middle of the reaction proceeding in the solvent containing the toner constituent.

The toner particle having such a substantially true sphere form is preferably prepared by the following method: Toner constituents including at least a polyester prepolymer having a functional group having a nitrogen atom, another polyester resin, a colorant and a release agent are dissolved or dispersed in an aqueous solvent in the presence of a particulate resin to crosslink and/or elongate the polyester prepolymer for preparing toner particles.

The toner constituents and toner manufacturing method are described.

Polyester

Polyesters are obtained when polyols (PO) and polycarboxylic compounds are subject to polycondensation reaction.

Suitable preferred polyols (PO) include diols (DIO) and polyols (TO) having three or more hydroxyl groups. It is preferable to use diols (DIO) alone or mixtures in which a small amount of a polyol (TO) is added to a diol (DIO).

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferable to use dicarboxylic acids (DIC) alone or mixtures in which a small amount of a polycarboxylic acid (TC) is added to a dicarboxylic acid (DIC).

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

Suitable mixing ratio (i.e., an equivalence ratio [OH]/[COOH]) of a polyol (PO) to a polycarboxylic acid (PC) ranges from 2/1 to 1/1, preferably from 1.5/1 to 1/1 and more preferably from 1.3/1 to 1.02/1.

Polyols (PO) and polycarboxylic acid (PC) are subjected to polycondensation reaction as follows:

(1) Heat a polyol and a polycarbonic acid to 150 to 280° C. in the presence of a known esterification catalyst such as tetra butoxy titanate and dibutyl tin oxide.

(2) Remove the generated water while decreasing the pressure if necessary or desired to obtain a polyester having a hydroxyl group. The polyester obtained preferably has a hydroxyl value of at least 5 and normally has an acid value of from 1 to 30 and preferably from 5 to 20. When a polyester has an acid value, the polyester can be easily charged with a negative polarity. In addition, a toner including such a polyester has a good affinity with a recording paper and therefore the low temperature fixability of the toner improves when fixing the toner onto the recording paper. However, when the acid value is too large, the charging stability of the toner can deteriorate due to environmental changes.

The weight average molecular weight is from 10,000 to 400,000 and preferably from 20,000 to 200,000. It is not preferred not to have too small weight average molecular weight because anti-offset properties deteriorate. It is not also preferred not to have too large weight average molecular weight because low temperature fixability deteriorates.

Other than the unmodified polyesters obtained from the polycondensation reaction mentioned above, suitable preferred examples of polyesters include urea-modified polyesters. Urea-modified polyesters are prepared by the following method:

(1) React an end, for example, a carboxyl group and hydroxyl group, of the polyester obtained from the polycondensation reaction mentioned above with polyisocyanates (PIC) to obtain a polyester prepolymer (A) having an isocyanate group; and (2)Then react the polyester prepolymer (A) with amines to have cross-linked and/or elongated molecular chains.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisoycantes (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (PIC) to a polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Specific examples of the amines (B), which are to be reacted with a polyester prepolymer (A), include diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

The mixing ratio (i.e., a ratio [NCO]/[NHx]) of the content of the prepolymer (A) having an isocyanate group to the amine (B) ranges from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The modified polyesters may include a urethane linkage as well as a urea linkage. The molar ratio (urea/urethane) of the urea linkage to the urethane linkage may vary from 100/0 to 10/90, preferably from 80/20 to 20/80 and more preferably from 60/40 to 30/70. When the content of the urea linkage is too low, the hot offset resistance of the resultant toner deteriorates.

Urea-modified polyesters can be prepared in different ways, including, for example, one-shot methods:

(1) Heat a polyol and a polycarbonic acid to 150 to 280° C. in the presence of a known esterification catalyst such as tetra butoxy titanate and dibutyl tin oxide.

(2) Remove the generated water while decreasing the pressure if necessary to obtain a polyester having a hydroxyl group.

(3) React the polyester with a polyisocyanate (PIC) at temperatures in the range of from 40 to 140° C. to obtain a polyester prepolymer (A) having an isocyanate group.

(4) React the prepolymer (A) with an amine (B) at temperatures in the range of from 0 to 140° C. to obtain a urea-modified polyester.

A solvent or mixture of solvents can be optionally used for the reaction of the polyester with the (PIC) and the reaction of the polymer (A) with the amine (B).

Usable solvents should be inactive to isocyanates (PIC) and suitable preferred solvents include, but are not limited to, aromatic solvents such as toluene and xylene; ketones such as acetone, methyl ethyl ketone and methyl isobutyl ketone; esters such as acetic ether; amides such as dimethyl formamide and dimethyl acetamide; and ethers such as tetrahydrofuran.

In the crosslinking reaction and/or elongation reaction of a polyester prepolymer (A) with an amine (B), a reaction inhibitor can be used if desired to control the molecular weight of the resultant urea-modified polyester. Specific examples of such a reaction inhibitor include monoamines (e.g., diethyl amine, dibutyl amine, butyl amine and lauryl amine), and blocked amines (i.e., ketimine compounds) prepared by blocking the monoamines mentioned above.

The weight average molecular weight of the urea-modified polyesters is not less than 10,000, preferably from 20,000 to 10,000,000 and more preferably from 30,000 to 1,000,000. When the weight average molecular weight is too low, the hot offset resistance of the resultant toner deteriorates. The number average molecular weight of the urea-modified polyesters is not particularly limited (i.e., the weight average molecular weight should be primarily controlled so as to be in the range mentioned above) when the unmodified polyester resin mentioned above is used in combination. Namely, controlling of the weight average molecular weight of the modified polyester resins has priority over controlling of the number average molecular weight thereof. However, when a urea-modified polyester is used alone, the number average molecular weight thereof is from 2,000 to 15,000, preferably from 2,000 to 10,000 and more preferably from 2,000 to 8,000. When the number average molecular weight is too large, the low temperature fixability of the resultant toner deteriorates, and in addition the gloss of full color images decreases when the toner is used in a full color image forming apparatus.

By using a combination of a urea-modified polyester with an unmodified polyester, the low temperature fixability of the toner improves and in addition the toner can produce color images having high gloss when the toner is used in the full-color image forming apparatus 100. Therefore, the combinational use of an unmodified polyester and a urea-modified polyester is preferable to a single use of the urea-modified polyester. As the unmodified polyester, polyester resins modified by a linkage (such as urethane linkage) other than a urea linkage, can also be used as well as unmodified polyester resins. When a mixture of a modified polyester with a urea-unmodified polyester is used, it is preferred that the modified polyester at least partially mix with the unmodified polyester in terms of the low temperature fixability and hot offset resistance of the resultant toner. It is preferred that the unmodified polyester have a structure similar to that of the urea-modified polyester. The mixing ratio of an unmodified polyester to a urea-modified polyester varies from 20/80 to 95/5, preferably from 70/30 to 95/5, more preferably from 75/25 to 95/5, and even more preferably from 80/20 to 93/7. When the added amount of urea-modified polyester is too small, the hot offset resistance of the resultant toner deteriorates and, in addition, it is hard to impart a good combination of high temperature preservability and low temperature fixability to the resultant toner.

The binder resin including the unmodified polyester and the modified polyester has a glass transition temperature (Tg) of from 45 to 65° C., and preferably from 45 to 60° C. When the glass transition temperature is too low, the high temperature preservability of the toner deteriorates. In contrast, when the glass transition temperature is too high, the low temperature fixability of the toner deteriorates.

Since a urea-modified polyester resin tends to exist on the surface of the toner particle obtained, the resultant toner tends to show good high temperature preservability comparative with conventional toners containing a polyester resin as a binder resin even if the binder resin has a relatively low glass transition temperature.

Colorant

The toner of the present invention includes a colorant.

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G. Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G. Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y. Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

Master batch pigments, which are prepared by combining a colorant with a resin, can be used as the colorant of the toner for use in the image forming apparatus of the present invention. Specific examples of the resin for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

Charge Controlling Agent

The toner for use in the image forming apparatus of the present invention includes a charge controlling agent.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® 03 (Nigrosine dyes), BONTRON® P-51 (quaternary ammonium salt), BONTRON® S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

Release Agent

The toner for use in the image forming apparatus of the present invention includes a release agent. Suitable release agents include waxes having a melting point of from 50 to 120° C. When such a wax is included in the toner, the wax is dispersed in the binder resin and serves as a release agent at a location between a fixing roller and the toner particles. Thereby hot offset resistance can be improved without applying an oil to the fixing roller used.

In the present invention, the melting point of the release agents is measured by a differential scanning calorimeter (DSC). The maximum absorption peak is defined as the melting point.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The charge controlling agent, and the release agent can be kneaded with a masterbatch and a binder resin. In addition, the charge controlling agent, and the release agent can be added to an organic solvent when the toner constituent liquid is prepared.

Now, the method for manufacturing the toner for use in the present invention is disclosed. However, the manufacturing method is not limited to the examples presented herein below.

(Method of Manufacturing a Toner)

(1) First, toner constituents including a colorant, an unmodified polyester resin, a polyester prepolymer having an isocyanate group, and a release agent are dissolved or dispersed in an organic solvent to prepare a toner constituent liquid.

Suitable preferred organic solvents include volatile organic solvents having a boiling point less than 100° C. since such solvent can be easily removed from the resultant toner particle dispersion.

Specific examples of the organic solvents include toluene, xylene, benzene, carbon tetrachloride, methylene chloride, 1,2-dichloroethane, 1,1,2-trichloroethane, chloroform, monochlorobenzene, dichloroethylidene, methyl acetate, ethyl acetate, methyl ethyl ketone, methyl isobutyl ketone, etc. These can be used alone or in combination. In particular, aromatic solvents such as toluene and xylene, and halogenated hydrocarbons such as 1,2-dichloroethane, chloroform and carbon tetrachloride are preferably used.

The addition quantity of the organic solvent is from 0 to 300 parts by weight, preferably from 0 to 100 parts by weight and more preferably from 25 to 70 parts by weight, per 100 parts by weight of the polyester prepolymer used.

(2) The toner constituent liquid is emulsified in an aqueous medium in the presence of a surfactant and a particulate resin.

Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone).

The mixing ratio (A/T) of the aqueous medium (A) to the toner constituent liquid (T) is from 50/100 to 2000/100 by weight, and preferably from 100/100 to 1000/100 by weight. When the content of the aqueous medium is too low, the toner constituent liquid may not be well dispersed, and thereby toner particles having a desired particle diameter may not be produced. In contrast, when the content of the aqueous medium is too high, the manufacturing cost of the toner increases.

When the toner constituent liquid is dispersed in an aqueous medium, a dispersant can be preferably used to prepare a stable dispersion.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a good dispersion can be prepared even when a small amount of the surfactant is used. Specific examples of the anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include primary, secondary and tertiary aliphatic amino acids, aliphatic quaternary ammonium salts (such as perfluoroalkyl(C6-C10)sulfoneamidepropyltrimethylammonium salts), benzalkonium salts, benzetonium chloride, pyridinium salts, imidazolinium salts, etc., all of which have a fluoroalkyl group Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, particulate polymers can be added to stabilize the resultant mother toner particles formed in an aqueous medium. Therefore it is preferred that a particulate polymer be added to the aqueous medium such that the surface of the mother toner particles are covered with the particulate polymer at a covering ratio of from 10 to 90%.

Specific examples of the particulate polymers include particulate polymethyl methacylate having a particle diameter of from 1 to 3 μm, particulate polystyrene having a particle diameter of from 0.5 to 2 μm, particulate styrene-acrylonitrile copolymers having a particle diameter of 1 μm, etc. Specific examples of the marketed particulate polymers include PB-200H (from Kao Corp.), SGP (Soken Chemical & Engineering Co., Ltd.), TECHNOPOLYMER® SB (Sekisui Plastics Co., Ltd.), SPG-3G (Soken Chemical & Engineering Co., Ltd.), MICROPEARL® (Sekisui Fine Chemical Co., Ltd.), etc.

In addition, an inorganic dispersant can be added to the aqueous medium. Specific examples of the inorganic dispersants include tricalcium phosphate, calcium carbonate, titanium oxide, colloidal silica, hydroxyapatite, etc.

Further, it is possible to stably disperse toner constituents in an aqueous medium using a polymeric protection colloid in combination with the inorganic dispersants and/or particulate polymers mentioned above.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose, can also be used as the polymeric protective colloid.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 μm to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

(3) At the same time when a toner constituent is dispersed in an aqueous medium, an amine (B) is added to the aqueous medium to be reacted with the polyester prepolymer (A) having an isocyanate group.

This reaction accompanies crosslinking and/or elongation of the molecular chains of the polyester prepolymer (A). The reaction time is determined depending on the reactivity of the amine (B) with the polyester prepolymer used, but is typically from 10 minutes to 40 hours, and preferably from 2 to 24 hours. The reaction temperature is from 0 to 150° C., and preferably from 40 to 98° C. In addition, known catalysts such as dibutyltin laurate and dioctyltin laurate, can be used for the reaction, if desired.

(4) After the reaction, the organic solvent is removed from the resultant dispersion (emulsion, or reaction product), and then the solid components are washed and then dried. Thus, a mother toner is prepared.

In order to remove the organic solvent, the system is gradually heated while agitated under laminar flow conditions. Then the system is strongly agitated in a certain temperature range, followed by solvent removal, to prepare a mother toner having a spindle form.

When compounds such as calcium phosphate, which are soluble in an acid or alkali, are used as a dispersion stabilizer, it is preferable to dissolve the compounds by adding an acid such as hydrochloric acid, followed by washing the resultant particles with water to remove calcium phosphate therefrom. In addition, calcium phosphate can be removed using a zymolytic method.

(5) Subsequently, a charge controlling agent is fixedly adhered to the mother toner. In addition, an external additive such as combinations of a particulate silica and a particulate titanium oxide, is adhered to the mother toner particle to prepare the toner of the present invention.

In the process of preparing a developer by adding an external additive and a lubricant, it is possible to add and mix both of them simultaneously or separately. To mix external additives, etc., powder mixers are used. In addition, it is preferred that the powder mixers be equipped with a jacket and the like to adjust the internal temperatures thereof. Specific preferred examples of mixing facilities include v-type mixers, rocking mixers, Loedige Mixers, Nauta mixers and Henschel mixers. It is preferred to prevent an external additive from being embedded and a lubricant from forming a thin film on the toner by varying the mixing conditions such as the number of the rotation, the speed of nutation, time and temperature.

By using this manufacturing method, the resultant toner can have a relatively small particle diameter and a narrow particle diameter distribution. By controlling the strong agitation during the solvent removing process, the shape of the toner can be controlled so as to be of a desired form, i.e., a form between a rugby ball and a true sphere form. In addition, the surface characteristics of the toner can also be controlled to produce a surface having a desired roughness, i.e., a surface that is not too smooth or too rough.

External additives can boost fluidity, developability and chargeability of toner particles. Suitable preferred external additives include particulate inorganic materials. Hydrophobic silica and/or hydrophobic titanium oxide are preferred. These particulate inorganic materials preferably have a primary particle diameter between 5 nm and 2 μm, and more preferably between 5 nm and 500 nm. In addition, it is preferred that the specific surface area of such particulate inorganic materials measured by a BET method be from 20 to 500 m2/g. The content of this external additive is preferably from 0.01 to 5% by weight, and more preferably from 0.01 to 2.0% by weight, based on the total weight of the toner composition.

Specific examples of such inorganic particulate materials include alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. Other than the above, particulate polymers, (which can be prepared by a method such as soap free emulsion polymerization, suspension polymerization or dispersion polymerization), such as copolymers of polystyrene, methacrylic acid esters and acrylic acid esters, particulate polycondensation compounds (e.g., silicone resins, benzoguanamine resins and nylons), and polymers of thermosetting resins can also be used.

When such external additives (fluidizers) are surface treated to improve hydrophobicity, good fluidity and chargeability can be maintained even in a high humidity environment. Suitable surfactants for use in the hydrophobizing treatment include silane coupling agents, silylation agents, silane coupling agents having a fluorinated alkyl group, organic titanate coupling agents, aluminum coupling agents, silicone oils, modified silicone oils, etc.

The toner of the present invention can be mixed with a magnetic carrier and used as a two component developer. The ratio of the carrier to the toner is preferably 100/1 to 100/10 by weight. Also, the toner of the present invention can be used as a single component magnetic or non-magnetic toner without using a carrier.

The image forming apparatus 100 of the present invention contains a detachable process cartridge which integrally supports the photoconductor 1 and at least one device selected from the group consisting of the lubricant applicator 21, the charger 2, the developing device 5 and the cleaner 7. To the image forming apparatus 100 the PCL 20 is provided as irradiator and therefore the image forming apparatus 100 can clear the photoconductor 1 of even a toner having a circularity not less than 0.94.

In addition, the image forming apparatus can use a detachable process cartridge which integrally supports the photoconductor 1 and at least one device selected from the group consisting of the lubricant applicator 21, the charger 2, the developing device 5 and the cleaner 7 and further includes the PCL 20 located on the upstream side from the cleaner 7 relative to the rotation direction of the photoconductor 1 as irradiating device to discharge the photoconductor 1. The PCL 20 provided to the process cartridge can attenuate the remaining potential of the photoconductor 1, including the electric field of the edge portions between white background portions and image portions, thereby reducing the attraction force between the toner and the photoconductor 1 and restraining the occurrence of poor cleaning performance.

As discussed above, the image forming apparatus of the present invention can obtain quality images by using toners having a substantially true sphere form. Further, by having the PCL functioning as irradiator, the image forming apparatus which can easily remove the toners remaining on the photoconductor with a cleaning blade is provided.

In addition, by having the PCL functioning as irradiator, the process cartridge of the present invention which can easily remove the toner particles remaining on the photoconductor with a cleaning blade and has a long life by using the toners having a true sphere form to improve the transfer rate of the toners, resulting in decrease of the amount of waste toner is provided.

Figure 7:
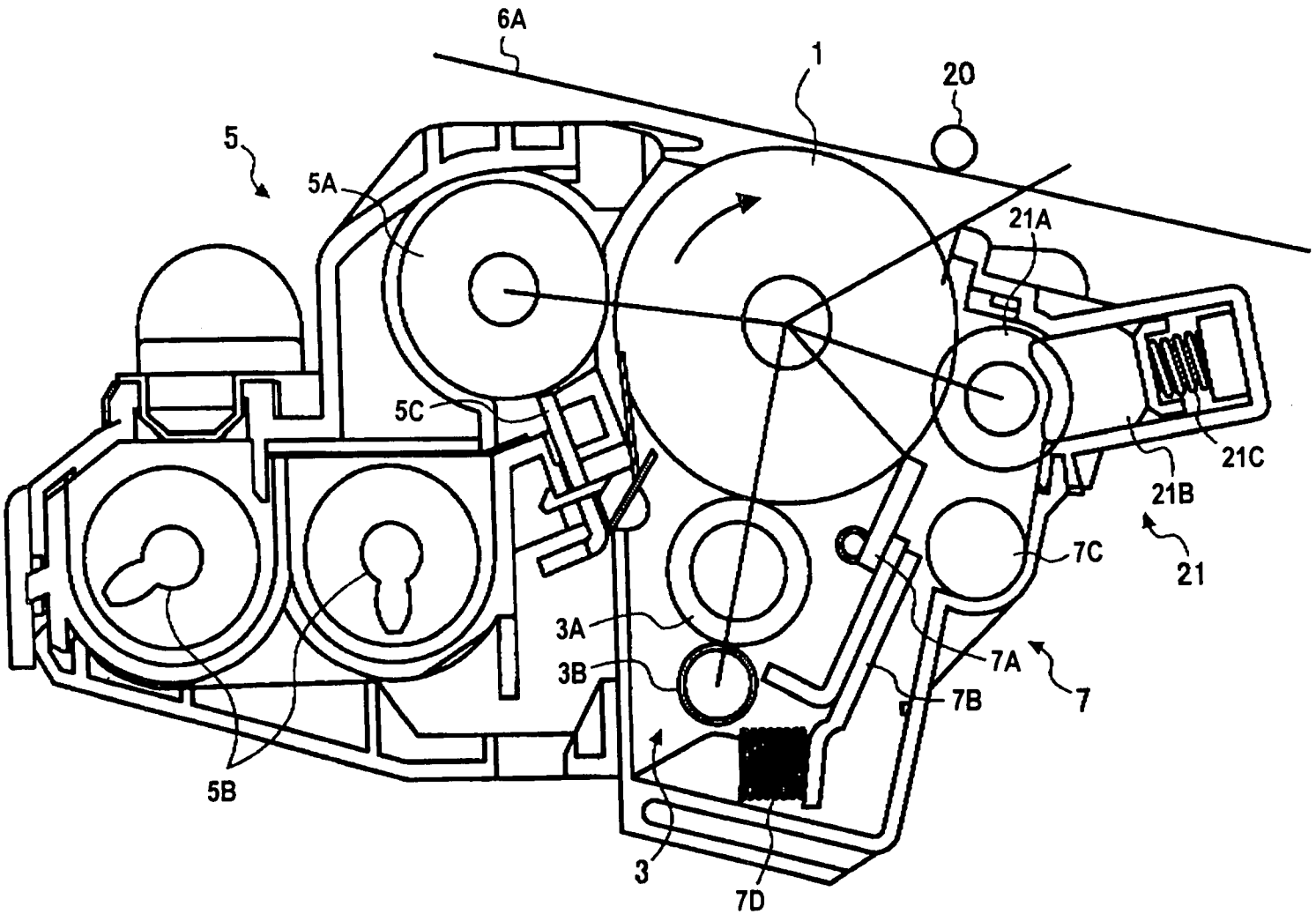
FIG. 7 is an elevation view of the process cartridge according to an embodiment of the present invention in which a surface moving member is transparent, and an irradiating device discharges an image bearing member by irradiating light through the transparent surface moving member.

FIG. 7 depicts an embodiment of the present invention in which a transparent surface moving member is provided. In this embodiment, the irradiating device is configured to discharge the latent image bearing member by irradiating the latent image bearing member with light through the transparent surface moving member.

It is to be understood that changes and modifications to the above disclosed embodiments and inventions can be made thereto without departing from the spirit and scope of the embodiments of the invention as set forth herein.

The invention claimed is:

1. An image forming apparatus comprising:

a latent image bearing member configured to bear a latent image thereon;

a charger comprising a charging member configured to contact or be located adjacent the latent image bearing member to charge the latent image bearing member;

a latent image forming device configured to form a latent image on the latent image bearing member;

a developing device configured to develop the latent image on the latent image bearing member with a toner;

a surface moving member comprising a surface configured to move while contacting the latent image bearing member;

a transfer device configured to transfer the toner image formed on the latent image bearing member to the surface moving member or to a recording material disposed between the latent image bearing member and the surface moving member while forming a transferring electric field between the latent image bearing member and the surface moving member;

a cleaner configured to clean the latent image bearing member of the toner remaining thereon;

an irradiating device configured to emit light to discharge the latent image bearing member, the irradiating device disposed on an upstream side from the cleaner relative to a rotation direction of the latent image bearing member;

a base plate configured to support said irradiating device; and a light shield member provided between the surface of the surface moving member and said irradiating device, wherein the light shield member is configured to prevent light irradiated from the irradiating device, from reaching the surface of the surface moving member and said irradiating device is sandwiched in between said base plate and said light shield member.

2. The image forming apparatus according to claim 1, further comprising:

a lubricant applicator comprising a brush roller configured to abrasively scrape a molded lubricant and to apply the lubricant to the latent image bearing member.

3. The image forming apparatus according to claim 2, wherein the latent image bearing member has a friction factor not greater than 0.4.

4. The image forming apparatus according to claim 2, wherein the lubricant applicator is disposed in the cleaner.

5. The image forming apparatus according to claim 2, comprising:

a process cartridge configured to be detachably attached to the image forming apparatus, wherein the latent image bearing member and at least one of the lubricant applicator, the charger, the developing device, and the cleaner are disposed in the process cartridge.

6. The image forming apparatus according to claim 5, wherein the latent image bearing member and the at least one of the lubricant applicator, the charger, the developing device, and the cleaner are integrally supported in the process cartridge.

7. The image forming apparatus according to claim 5, wherein the irradiating device is disposed in the process cartridge.

8. The image forming apparatus according to claim 7, wherein the latent image bearing member, the at least one of the lubricant applicator, the charger, the developing device, and the cleaner, and the irradiating device are integrally supported in the process cartridge.

9. The image forming apparatus according to claim 1, wherein the irradiating device comprises an electroluminescence or light emitting diode.

10. The image forming apparatus according to claim 1, wherein the toner has a first form factor of from 100 to 180 and a second form factor of from 100 to 180.

11. The image forming apparatus according to claim 1, wherein the toner has a volume average particle diameter of from 3 to 8 μm, and the toner has a ratio of the volume average particle diameter to a number average particle diameter of the toner of from 1.05 to 1.40.

12. The image forming apparatus according to claim 1, wherein the toner satisfies the following relationships:

$$0.5 \leqq r2/r1 \leqq 1.0; \text{ and}$$

$$0.7 \leqq r3/r2 \leqq 1.0,$$

wherein r1 is a major-axis particle diameter of the toner, r2 is a minor-axis particle diameter of the toner, and r3 is a thickness of the toner, and r3 $\leqq$r2 $\leqq$r1.

13. The image forming apparatus according to claim 1, wherein:

said transfer device is configured to transfer the toner image formed on the latent image bearing member to the surface moving member or to the recording material disposed between the latent image bearing member and the surface moving member at a transfer area; and said irradiating device is configured to emit light on a downstream side of the transfer area to discharge the latent image bearing member.

14. The image forming apparatus according to claim 1, wherein the toner has a circularity not less than 0.94.

15. The image forming apparatus according to claim 1, wherein said charging member is a charging roller, and wherein said charger further includes a cleaning roller configured to clean a surface of the charging roller.

16. The image forming apparatus according to claim 1, wherein said cleaner comprises a cleaning blade.

17. The image forming apparatus according to claim 1, wherein said surface moving member is transparent, and wherein said irradiating device is configured to discharge said latent image bearing member by irradiating said latent image bearing member with light through said transparent surface moving member.

18. An image forming apparatus comprising:

a latent image bearing member configured to bear a latent image thereon;

a charger comprising a charging member configured to contact or be located adjacent the latent image bearing member to charge the latent image bearing member;

a latent image forming device configured to form a latent image on the latent image bearing member;

a developing device configured to develop the latent image on the latent image bearing member with a toner;

a surface moving member comprising a surface configured to move while contacting the latent image bearing member;

a transfer device configured to transfer the toner image formed on the latent image bearing member to the surface moving member or to a recording material disposed between the latent image bearing member and the surface moving member at a transfer area while forming a transferring electric field between the latent image bearing member and the surface moving member;

a cleaner configured to clean the latent image bearing member of the toner remaining thereon; and an irradiating device configured to emit light at a downstream side of the transfer area to discharge the latent image bearing member, the irradiating device disposed on an upstream side from the cleaner relative to a rotation direction of the latent image bearing member, wherein the surface moving member is transparent, and wherein the irradiating device is configured to discharge the latent image bearing member by irradiating the latent image bearing member with light through the transparent surface moving member.

19. The image forming apparatus according to claim 18, wherein the toner has a circularity not less than 0.94.

20. The image forming apparatus according to claim 18, wherein said cleaner comprises a cleaning blade.

21. A process cartridge configured to be detachably attached to an image forming apparatus, comprising:

a latent image bearing member configured to bear a latent image thereon;

a charger comprising a charging roller configured to contact or be located adjacent the latent image bearing member to charge the latent image bearing member, and a cleaning roller configured to clean a surface of the charging roller;

a developing device configured to develop the latent image on the latent image bearing member with a toner;

a cleaner configured to clean the latent image bearing member of the toner remaining thereon;

an irradiating device configured to discharge the latent image bearing member disposed on an upstream side from the cleaner relative to a rotation direction of the latent image bearing member;

a base plate configured to support said irradiating device; and a light shield member configured to block light and attached to said irradiating device, wherein said irradiating device is sandwiched in between said base plate and said light shield member.

22. The process cartridge according to claim 21, wherein said light shield member is provided to surround an outer surface of the irradiating device disposed facing outside a case of the process cartridge.

23. The process cartridge according to claim 21, comprising the developing device configured to develop the latent image on the latent image bearing member with the toner having a circularity not less than 0.94.

24. The process cartridge according to claim 21, further comprising a lubricant applicator configured to apply a lubricant to the latent image bearing member.

25. The process cartridge according to claim 24, wherein the latent image bearing member, the cleaner, and at least one of the lubricant applicator, the charger, and the developing device, and the irradiating device are integrally supported in the process cartridge.

26. The process cartridge according to claim 21, wherein said light shield member is made of black mylar.

27. The process cartridge according to claim 21, wherein said base plate is mounted to a case of said process cartridge.

28. An image forming apparatus comprising:

means for bearing a latent image thereon;

means for charging the means for bearing the latent image;

means for forming the latent image on the means for bearing the latent image;

means for developing the latent image on the means for bearing the latent image with a toner;

means for moving a surface with the means for bearing the latent image;

means for transferring the toner image to the means for moving the surface or to a recording material while forming a transferring electric field between the means for bearing the latent image and the means for moving the surface;

means for cleaning the means for bearing the latent image;

means for discharging the means for bearing the latent image by emitting light, the means for discharging disposed on an upstream side from the means for cleaning relative to a rotation direction of the means for bearing the latent image;

a base plate configured to support the means for discharging; and a light shield member configured to block light and attached to the means for discharging, wherein the means for discharging is sandwiched in between the base plate and the light shield member.

29. The image forming apparatus according to claim 28, wherein:

said means for transferring is configured to transfer the toner image at a transfer area; and said means for discharging is configured to emit light on a downstream side of the transfer area to discharge the means for bearing the latent image.

30. The image forming apparatus according to claim 28, wherein the toner has a circularity not less than 0.94.

31. The image forming apparatus according to claim 28, wherein the means for charging further comprises means for cleaning the means for charging.

32. A process cartridge configured to be detachably attached to an image forming apparatus, comprising:

means for bearing a latent image thereon;

means for cleaning the means for bearing the latent image;

means for charging the means for bearing the latent image;

means for developing the latent image on the means for bearing the latent image;

means for discharging the means for bearing the latent image, the means for discharging disposed on an upstream side from the means for cleaning relative to a rotation direction of the means for bearing the latent image;

a base plate configured to support the means for discharging; and a light shield member configured to block light and attached to the means for discharging, wherein the means for discharging is sandwiched in between the base plate and the light shield member.

33. The process cartridge according to claim 32, wherein the toner has a circularity not less than 0.94.

34. The process cartridge according to claim 32, wherein the means for charging further comprises means for cleaning the means for charging.

35. The process cartridge according to claim 32, further comprising means for applying a lubricant to the means for bearing the latent image.

* * * * *